United States Patent [19]

McCubbin et al.

[11] 4,351,239

[45] Sep. 28, 1982

[54] WARHEAD, INCENDIARY

[75] Inventors: Melvin J. McCubbin; Clifford T. Johnson, both of Ridgecrest, Calif.

[73] Assignee: The United States of America as represented by the Secretary of the Navy, Washington, D.C.

[21] Appl. No.: 553,851

[22] Filed: Feb. 28, 1975

[51] Int. Cl.[3] ..... F42B 11/24

[52] U.S. Cl. ..... 102/364; 102/493; 102/496

[58] Field of Search ..... 102/66, 67, 364, 493, 102/496

[56] References Cited

U.S. PATENT DOCUMENTS

| | | | |
|---|---|---|---|
| 2,801,590 | 8/1957 | Balke et al. | 102/90 |
| 3,474,731 | 10/1969 | Thomanek | 102/67 |
| 3,498,224 | 3/1970 | Cordle et al. | 102/67 |
| 3,830,671 | 8/1974 | McArdle | 102/66 |

FOREIGN PATENT DOCUMENTS

| | | | |
|---|---|---|---|
| 669449 | 8/1963 | Canada | 102/67 |
| 1177716 | 12/1958 | France | 102/67 |

*Primary Examiner*—Verlin R. Pendegrass

*Attorney, Agent, or Firm*—W. F. Beers; W. Thom Skeer

[57] ABSTRACT

The lethality of a fragmentation warhead is increased by including pyrophoric material consisting of spongy zirconium metal rings in combination with the fragmentation material.

2 Claims, 1 Drawing Figure

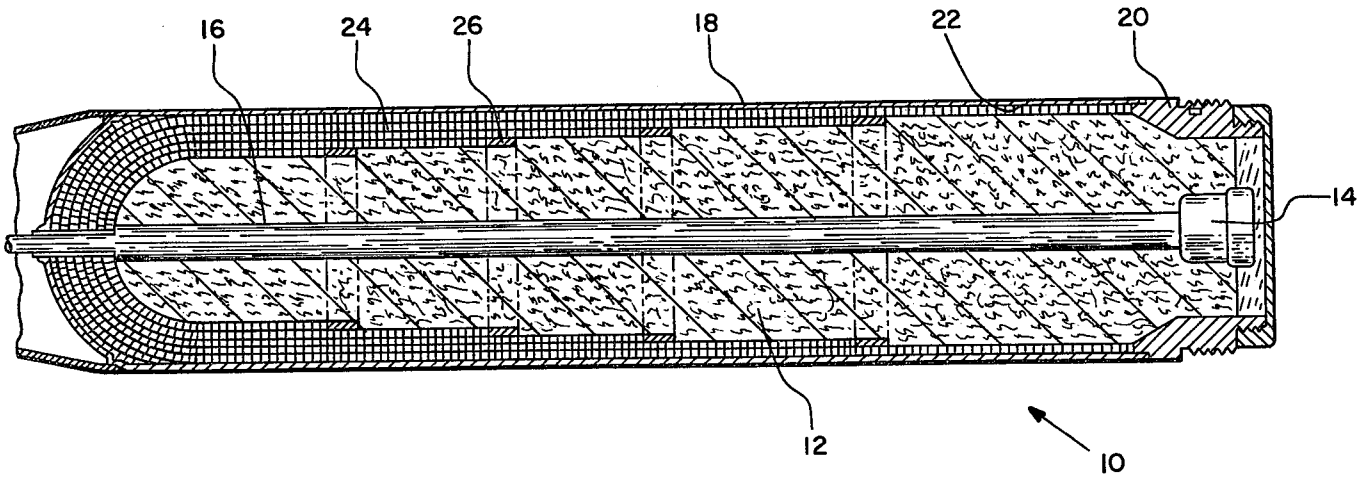
14
20
22
18
26
24
16
10
12

WARHEAD, INCENDIARY

CROSS REFERENCE TO RELATED PATENT APPLICATIONS

The present invention is an improvement on assignee's prior application, Ser. No. 766,040 filed Oct. 4, 1968 and now U.S. Pat. No. 3,498,224. The invention described herein is also a species of the invention described and claimed in assignee's copending application Ser. No. 553,852, identified as Navy Case No. 56529 filed of even date.

BACKGROUND OF THE INVENTION

This invention relates to warheads and particularly to warheads designed to be incorporated in missiles and more particularly to a guided missile warhead having a fragmentation section comprising preformed metal cubes.

More particularly, the present invention relates to the combining with such warheads of a pyrophoric material to give incendiary capabilty.

Warheads have, of course, been designed with accompanying means for producing fragments or shrapnel of various types and sizes and for various purposes and a very efficient example is shown in assignee's prior patent referenced above.

This prior warhead was very efficient against targets for which it was designed because of the control of fragment size and pattern. However, it was felt that the efficiency could be increased by adding further incendiary capability. Consequently several combinations have been proposed for adding incendiary and night marking capability to this warhead.

SUMMARY

According to the present invention a damage mechanism is provided which includes the combination with fragmentation warhead of spongy rings of zirconium metal. Since zirconium metal in the sponge form is easily ignited in air by a spark or a blow, the combination of these spongy rings with the fragmentation pattern of the prior warhead results in a very efficient night marker and also gives the capability of starting fires when used against targets including flammable material.

BRIEF DESCRIPTION OF THE DRAWING

The single FIGURE of the drawing is a longitudinal cross-sectional view of a fragmentation warhead according to the invention.

DESCRIPTION AND OPERATION

The warhead according to the invention is generally designated by the numeral 10 on the drawing and is shown as a missile warhead section. The warhead section 10 is designed for use in an air-to-surface weapon, for example, designed to seek out and destroy certain enemy installations. The weapon requires a warhead that will be effective against such targets, withstand all designated operational environment, and be safe to handle, store and transport. The warhead as shown also has provisions for interfacing with other missile components.

The missile warhead includes an explosive charge 12 which is fitted with a conventional arming and booster device 14 which device is designed to be initiated from a forward fuse mechanism (not shown) through a conduit 16. The assembly is fitted into an outer casing 18 which is provided with means 20 for attachment to other portions of a missible body. The warhead assembly includes a plurality of fragments 24 arranged in rows of various thicknesses in a manner better explained and understood by reference to assignee's prior U.S. Pat. No. 3,498,224 referenced above.

According to the present invention, the assembly also includes a plurality of zirconium sponge rings 26. These rings of spongy zirconium metal are easily ignited in air by a spark or a blow and add to the assembly a night marker capability as well as an incendiary capability. Physical properties of zirconium metal, including the spong form, may be found by reference to Kirk-Othmer, Encyclopedia of Chemical Technology, Vol. 15 (1956), page 283.

The zirconium sponge rings are approximately the thickness of one of the fragmentation cubes and about four cubes wide. In assembling the warhead, the rings are placed on the molded explosive in the warhead cavity and the space between the explosive and the outer casing filled with the fragment cubes as described in assignee's prior U.S. Pat. No. 3,498,224 referenced above.

We claim:

1. In a fragmentation warhead including;

an explosive charge extending along a longitudinal axis, a casing surrounding said explosive charge and extending concentrically therealong so as to contain the fragmentation warhead, a plurality of generally cylindrical layers of fragmentation elements arranged between said explosive charge and said casing to extend outer surface thereof in a direction along the longitudinal axis of said explosive charge, each layer having a length different from other layers and arranged with the longest extending layer outermost and adjacent said casing and progressively shorter extending layers concentrically positioned within said longest extending layer with the shortest extending layer innermost, adjacent said explosive charge, the improvement comprising:

a plurality of rings of zirconium sponge material equal in number to the number of layers of fragmentation elements, each having the same thickness as the layer of fragmentation elements, each having a length along said longitudinal axis greater than a single element, and positioned at the end of each layer to form an extension thereof, whereby the explosive fragmentation of said warhead is accompanied by an incendiary dispersal of pyrophoric zirconium sponge material.

2. The improvement of claim 1 in which the length of said rings is equal to four fragmentation elements.

* * * * *